United States Patent [19]

Greenwood

[11] 3,977,915

[45] Aug. 31, 1976

[54] METHOD OF HEAT TREATING METAL PARTS

[76] Inventor: Ronald E. Greenwood, 41 Terrace Drive, Hastings-on-Hudson, N.Y. 10706

[22] Filed: Jan. 30, 1975

[21] Appl. No.: 545,501

[52] U.S. Cl. ..... 148/13.1; 148/13.2; 148/14; 148/27

[51] Int. Cl.[2] ..... C22F 1/00

[58] Field of Search ..... 148/13.1, 13.2, 14, 148/27; 164/41

[56] References Cited

UNITED STATES PATENTS

| | | | |
|---|---|---|---|
| 2,989,428 | 6/1961 | Wilson | 148/13.1 |
| 3,172,176 | 3/1965 | Greenwood | 164/41 |

*Primary Examiner*—R. Dean
*Attorney, Agent, or Firm*—Philip Furgang

[57] ABSTRACT

Disclosed is a method for heat treating nonferrous metal parts. These parts are suspended in a settable ceramic slurry. The combination is formed into a solid mass by setting of a gelling binder contained therein. The set mass is then aged in an enveloping stabilizing or hardening atmosphere in which the volatile constituents of the binder are miscible. The formed mass of ceramic and metal parts is heat treated, the parts being held in suspension by the ceramic highly refractory material. Upon cooling, the differing thermal coefficients result in a disintegration of the ceramic from the heat treated parts.

41 Claims, No Drawings

METHOD OF HEAT TREATING METAL PARTS

BACKGROUND OF THE INVENTION

This invention relates to heat treatment of metal objects and more particularly, the heat treatment of such metal objects as springs, small metal parts, spring components, precision parts, and the like.

The heat treatment of metal objects, such as pressed metal parts and stampings, for the purpose of hardening, tempering, normalizing, annealing, or stress relieving, often results in distortion due to the relief of residual stresses. In order to prevent or minimize, as far as possible, such undesirable distortion, it is known to place such objects in various holding devices such as fine sand or to clamp them into the heat treatment furnace.

One of the earliest known methods of treating steel springs was proposed by Smith in U.S. Pat. No. 5,979, who suggested the use of jigs to hold such springs. Still another approach was suggested by Wilson in U.S. Pat. No. 2,989,428, in which such metal parts are first placed in a metal cannister and plaster of Paris is poured over the objects to hold them in place. The parts are then held by the hardened plaster of Paris and subjected to heat. Still a number of other suggestions have been made to coat metal parts with a glass frit for heat treating purposes.

The use of a fixture to hold individual metal parts is very expensive and a time consuming task, and has proved unacceptable over the years.

The heat necessary to produce molten glass to thereby form a hard and protective coating precludes the use of this method in connection with nonferrous springs such as copper or the like. This is because the temperature of molten glass is often higher than that to which nonferrous material, such as copper, would be subjected for purposes of heat treatment. In addition, and in particular for the treatment of nonferrous springs, it is important that the heat treatment be both rapid and uniform and that the drop in temperature be equally uniform.

In this connection, the method suggested by Wilson is equally inappropriate to nonferrous springs. Plaster is not a refractory material and does not conform to the definition of ceramic, as will be more fully discussed hereinafter. Nonferrous springs are frequently treated at a temperature in excess of 1200°F and plaster cannot sustain such temperatures. Furthermore, Wilson's method does not truly suspend the object to be treated in the ceramic material. Wilson is believed to propose that such objects be embedded at the base of the plaster and be supported during hardening by a metal tray so that the objects are not truly suspended therein. This thereby reduces the ability of the material to equally restrain metal parts. In addition, Plaster of Paris passes slowly through a semi-liquid stage so that it is difficult to set and hold objects in a suspended state within the mixture.

SUMMARY OF THE INVENTION

It is an object of this invention to overcome the above-noted disadvantages and to provide a simple and efficient method for supporting and locating metal objects to be heat treated, so as to prevent distortion thereof taking place during such treatment.

It is another object of this invention to provide an improved method of heat treatment of metal objects which is economical both in cost of operation and the avoidance of waste when compared to existing methods.

It is a further object to retain metal parts for heat treatment suspended in a ceramic material.

It is a still further object of this invention to provide a means for heat treating nonferrous metal parts.

In still another aspect of the invention, there is provided a method of heat treating metal parts which includes providing a settable ceramic slurry for receiving the metal parts. The parts are disposed and enveloped within the slurry so as to be suspended therein. The combination is then formed into a set mass wherein the metal parts are held rigidly in place.

Accordingly, in one aspect of this invention, there is provided the method of heat treating metal objects which comprises the steps of first providing a settable refractory slurry. Second, metal parts are deposited within the slurry. The mass is then set and stabilized to hold the metal parts in suspension therein. The mass of parts and refractory material is then dried and subjected to heat treating temperatures. The refractory material acts to hold the parts in a substantially fixed position, thereby preventing warpage of the parts. Finally, the mass is cooled and the differing thermal coefficients between the parts and the refractory material causes the mass to break up, thereby releasing the parts.

In still another aspect of this invention, inhibitors may be combined with the slurry to provide an atmosphere to treat the surface of the springs duirng the heat treating process.

DESCRIPTION OF THE PREFERRED EMBODIMENTS

The heat treatment of nonferrous springs and other metal parts is of some difficulty. As previously indicated, glass frit is frequently formed or flowed at too high a temperature to treat nonferrous springs. Embedding the springs in Plaster of Paris provides an insufficient bond to hold the springs during heat treatment temperatures.

Ceramics, which may be defined as materials of inorganic origin, generally clays or refractory earths, that can be shaped or formed at ordinary temperatures and fired at high temperatures to produce refractory substances, have been known to be ideally suited as materials in methods of processes of forming molds for molding parts. However, their use to suspend parts therein for heat treatment has, it is believed, not been known. One of the reasons for this may be that a slurry formed of such a ceramic has been generally understood not to set sufficiently evenly or firmly to suspend and hold without distortion such finely developed parts as metal springs.

However, the method of U.S. Pat. No. 3,172,176, disclosed by the same inventor as herein, suggests a method of making ceramic molds for casting metal parts therein which is particularly suitable to heat treating parts. Prior to this method of molding it has been observed that ceramic molds provided by other methods may harden unevenly and be subject to sagging or distortion. The method proposed in the aforementioned patent overcomes this problem by providing an additional aging, stabilizing or hardening step.

It has been observed that the process for making ceramic molds, as set forth in the aforementioned U.S. Patent, has a unique and unexpected use in treating metal parts. This unique method has been discovered to have a startling and surprising effect when applied to the step of suspension of metal parts within the ceramic mold material. This method is particularly useful for treating such nonferrous parts as copper alloy springs, but may also be applicable to other metal parts.

Thus, and in this connection, a settable ceramic slurry of finely comminuted refractory materials, as set forth in the aforementioned U.S. Pat. No. 3,172,176 is joined with an organic gelling binder, such as an alkyl silicate. This ceramic, being a very refractory material, may easily withstand the typical heat treatment temperatures of around 1000°–1450°F necessary for treating nonferrous parts.

The slurry may be placed in a container such as a bucket, together with a high temperature binder such as, though not limited to, the aforementioned alkyl silicate. This material, as previously indicated, is set forth more completely in the aforementioned U.S. Patent and is incorporated by reference herein. The aforementioned finely comminuted refractory material may be, for example, alumina, silica, zircon, or any combination thereof, or any other suitable refractory oxide or silicate as may be well known in the art.

The gelling of the ceramic and aging, as indicated in the aforementioned patent, reduces the tendency to develop small cracks in the surfaces or in general within the internal structure of the ceramic. After the ceramic form has been stabilized, the entire mass may be ignited to dry out or remove any flammable liquid volatiles that may be present from the binder. In the alternative, the entire mass may be dried in air or gas or in a vaccuum or in an oven or similar means at a temperature low enough not to effect the subsequent heat treatment cycle.

The gelling time of the slurry may be easily controlled. The slurry may be made of a thick consistency so that the parts disposed therein move slowly there through. The slurry is then caused to rapidly gell thereby suspending the parts therein. While suspension of the parts in the slurry is preferred, it is possible to successfully treat parts that are disposed at the bottom of the cannister holding the slurry.

Following the preliminary drying procedure, the entire ceramic mass, containing, for example, newly formed nonferrous springs, may be placed in any suitable furnace to provide the heat treatment cycle. During the furnace cycle, the springs or similar parts are properly heat treated without possibility of distortion or warpage due to the firm supporting ceramic.

After the heat treatment is completed, for a period of time well known in the art, the entire mass is allowed to cool. It will be obvious that the springs and the ceramic will have different coefficients of thermal contraction. The thermal coefficients between the ceramic and the metal create interstructural stresses. These stresses cause a breakdown of the ceramic bond at the interface between the spring and the ceramic and result in a tendency for the entire mass to partially disintegrate. The heat treatment cycle is substantially completed in this stage and any structural breakdown of the ceramic will have no effect on the contained heat treated parts. Any of the parts remaining in the ceramic may be removed therefrom by such mechanical methods as vibration, agitation, or impingement of a fluid such as gas or liquid, or other means well known in the art.

Another aspect of this invention is that the material forming the slurry may also provide an enveloping medium for the parts to be heat treated. This enveloping medium may be counted on to restrict exposure of the parts to air. Such exposure often results in oxidation, discoloration, or scaling or similar surface deterioration of the parts. Thus, it is possible to include within this slurry mixture any one of several inhibitors well known in the art that might activate during the drying or heating of the molded mass, and will further consume or chemically reduce any actual air or oxygen that may be present. Indeed, certain inhibitors may be employed that will generate or liberate a gas or atmosphere during the process and can provide special environments known in the heat treating art that are used to change or improve the quality of parts being heat treated. Thus, these inhibitors can also provide results known as bright annealing, carburizing, and the like. It is believed that special furnaces and atmospheres are normally required to obtain this condition. However, such relatively expensive equipment becomes unnecessary where the molded mass provided herein causes the generation of predetermined environmental conditions. Thus, only a simple and inexpensive heat treating furnace need by employed. It is to be understood that while the use of inhibitors in treating metal parts is well known, the employment of inhibitors dispersed through a hardenable slurry to thereafter be activated by heat is believed to provide a novel and unique method of treating metal parts.

It is to be further understood that reference to springs is only by way of example and any other metal parts may be so treated.

It should be further noted that while the emphasis herein is upon nonferrous metal parts, ferrous parts may also be included. However, there is provided herein a preferred relatively slow cooling period after the attainment of a maximum heat treatment temperature. This slow cooling process is more desirable for copper base parts or springs, but may also be applicable to ferrous alloys that may require an "air quench". However, it is acknowledged that most ferrous alloys tend to require a more rapid quench such as by means of oil or water. Further, such rapid quenches must be uniformly applied to the metal part. It is acknowledged that the ceramic provided herein is a relative insulator with a low rate of thermal transfer and heat loss, thereby resisting such type of rapid cooling.

It is preferred that the refractory material used herein be of a binary mesh distribution to provide good strength without great density. Furthermore, it is preferable that the particles making up the refractory material have a glassy form or texture so as to provide less mechanical bonding and to be more subject to breaking up as a result of the differential movement obtained during the cooling period.

It will be appreciated that the methods of heat treating metal parts are equally applicable to the prior art methods of making ceramic molds. Thus, the metal parts might be treated by being suspended in a mold material made in accordance with U.S. Pat. No. 2,795,022 by Shaw et al. (the so-called "Shaw Method") or by other similar methods that employ a volatile binder or by methods in which the gelling binder is not of a volatile nature. These methods are well known for making molds but have not been applied to heat treating suspended metal parts. These methods are to be understood to come within the methods recited and claimed herein and in which there is provided a step of setting and stabilizing the slurry mass and metal parts to form the metal-refractory mass.

What is claimed is:

1. The process of heat treating metal parts comprising:

a. providing a settable ceramic slurry;
b. depositing the metal parts in said slurry;
c. setting said mass of slurry and contained metal parts, so that said set slurry holds and supports the parts in suspension there within;
d. drying said mass;
e. subjecting said mass to heat treating temperatures;
f. cooling the heat treated mass so as to cause said ceramic material to partially disintegrate; and
g. separating the ceramic material from said heat treated parts.

2. The process of heat treating nonferrous metal parts comprising:

a. providing a settable ceramic slurry of the type including finely comminuted refractory material in combination with a gelling binder;
b. depositing the metal parts in said slurry to form a combined mass;
c. suspending the metal parts in said slurry and setting the combined mass by gelation, so that the parts are held and supported there within;
d. enveloping the set combined mass in a stabilizing medium sufficient to produce internal stabilization and aging thereof to form a rigid combination of said refractory materials with the parts;
e. drying the stabilized mass and subjecting it to metal heat treating temperatures, said refractory material acting to hold the parts in a substantially fixed position, thereby preventing warpage or distortion of the parts; and
f. cooling the mass, thereby causing the ceramic to separate from the parts as a result of different coefficients of thermal contraction between the parts and the ceramic.

3. The heat treating process as recited in claim 1, wherein said step of providing a settable ceramic slurry comprises providing a ceramic of finely comminuted refractory material and providing a gelling binder.

4. The heat treating process as recited in claim 3, wherein said step of providing a gelling binder comprises providing a binder having as a constituent thereof a volatile material.

5. The heat treating process as recited in claim 4, wherein after the step of setting, said process comprises the step of stabilizing said mass.

6. The heat treating process as recited in claim 5, wherein said step of stabilizing further comprises enveloping said mass in a stabilizing medium sufficient to produce internal stabilization and aging thereof and forming, as a result of said hardening and stabilizing means, a rigid combination of said refractory material and the parts.

7. The heat treating process as recited in claim 6, wherein said step of enveloping comprises drying said volatile material from said mass in the medium of air.

8. The heat treating process as recited in claim 6, wherein said step of enveloping comprises immersing said mass in a medium in which said volatile material is miscible.

9. The heat treating process as recited in claim 8, wherein said step of enveloping further comprises providing water as said miscible medium.

10. The heat treating process as recited in claim 9, wherein said step of enveloping further comprises placing said base into boiling water for ten to fifteen minutes.

11. The heat treating process as recited in claim 4, wherein said step of drying comprises ignition of said volatile material and burning from said mass after said mass has set.

12. The heat treating process as recited in claim 7, wherein said step of providing a ceramic material of finely comminuted refractory material consisting of one or more of the materials of the group consisting of alumina, silica, or zircon.

13. The heat treating process as recited in claim 12, where said step of providing a settable refractory slurry further comprises providing an organic gelling binder of an alkyl silicate.

14. The heat treating process as recited in claim 13, wherein said step of subjecting said mass to heat treating temperatures comprises heating said mass in a furnace at temperatures exceeding 1000°F.

15. The heat treating process as recited in claim 10, wherein said step of providing a ceramic material of finely comminuted refractory material consisting of one or more of the materials of the group consisting of alumina, silica, or zircon.

16. The heat treating process as recited in claim 15, wherein said step of providing a settable refractory slurry further comprises providing an organic gelling binder of an alkyl silicate.

17. The heat treating process as recited in claim 16, wherein the step of subjecting said mass to heat treating temperatures comprises heating said mass in a furnace at temperatures exceeding 1000°F.

18. The heat treating process as recited in claim 11, wherein said step of providing a ceramic material of finely comminuted refractory material consisting of one or more of the materials of the group consisting of alumina, silica, or zircon.

19. The heat treating process as recited in claim 18, wherein said step of providing a settable refractory slurry further comprises providing an organic gelling binder of an alkyl silicate.

20. The heat treating process as recited in claim 19, wherein the step of subjecting said mass to heat treating temperatures comprises heating said mass in a furnace at temperatures exceeding 1000°F.

21. The heat treating process as recited in claim 14, wherein said step of providing said ceramic material comprises providing inhibitors.

22. The heat treating process as recited in claim 21, wherein said step of heating comprises consuming with said inhibitors oxygen about the parts.

23. The heat treating process as recited in claim 21, wherein said step of heating comprises reducing chemically the oxygen about the parts with said inhibitors.

24. The heat treating process as recited in claim 17, wherein said step of providing said ceramic material comprises providing inhibitors.

25. The heat treating process as recited in claim 24, wherein said step of heating comprises consuming with said inhibitors oxygen about the parts.

26. The heat treating process as recited in claim 25, wherein said step of heating comprises reducing chemically the oxygen about the parts with said inhibitors.

27. The heat treating process as recited in claim 20, wherein said step of providing said ceramic material comprises providing inhibitors.

28. The heat treating process as recited in claim 27, wherein said step of heating comprises consuming with said inhibitors oxygen about the parts.

29. The process of heat treating as recited in claim 1 further comprises after said step of depositing said metal parts, enveloping and holding fully within said slurry said metal parts.

30. The process of heat treating as recited in claim 1 further comprises providing inhibitors with said settable refractory material and dispersing said inhibitors through said slurry; said step of subjecting said mass to heat treatment temperatures further comprises causing said inhibitors to produce a gaseous atmosphere for treating said metal parts.

31. The process of heat treating as recited in claim 6 further comprises after said step of depositing said metal parts, enveloping and holding fully within said slurry said metal parts.

32. The process of heat treating as recited in claim 6 further comprises providing inhibitors with said settable refractory material and dispersing said inhibitors through said slurry; said step of subjecting said mass to heat treatment temperatures further comprises causing said inhibitors to produce a gaseous atmosphere for treating said metal parts.

33. The process of heat treating as recited in claim 7 further comprises after said step of depositing said metal parts, enveloping and holding fully within said slurry said metal parts.

34. The process of heat treating as recited in claim 7 further comprises providing inhibitors with said settable refractory material and dispersing said inhibitors through said slurry; said step of subjecting said mass to heat treatment temperatures further comprises causing said inhibitors to produce a gaseous atmosphere for treating said metal parts.

35. The process of heat treating as recited in claim 10 further comprises after said step of depositing said metal parts, enveloping and holding fully within said slurry said metal parts.

36. The process of heat treating as recited in claim 10 further comprises providing inhibitors with said settable refractory material and dispersing said inhibitors through said slurry; said step of subjecting said mass to heat treatment temperatures further comprises causing said inhibitors to produce a gaseous atmosphere for treating said metal parts.

37. The process of heat treating as recited in claim 11 further comprises after said step of depositing said metal parts, enveloping and holding fully within said slurry said metal parts.

38. The process of heat treating as recited in claim 11 further comprises providing inhibitors with said settable refractory material and dispersing said inhibitors through said slurry; said step of subjecting said mass to heat treatment temperatures further comprises causing said inhibitors to produce a gaseous atmosphere for treating said metal parts.

39. The process as recited in claim 2, further comprises providing a container for holding said settable ceramic slurry and the parts.

40. The process as recited in claim 39, further comprises after said step of enveloping said combined mass, drying said combined mass.

41. The process as recited in claim 40, wherein said step of cooling said mass further comprises separating the parts from said ceramic by mechanical agitation.

* * * * *